US006238222B1

(12) United States Patent
Kuo et al.

(10) Patent No.: US 6,238,222 B1
(45) Date of Patent: May 29, 2001

(54) GROUNDING DEVICE FOR AN ELECTRICAL CONNECTOR

(75) Inventors: Peter Kuo, Chung-Ho; Hao Neng Shun, Tu-chen, both of (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/474,346

(22) Filed: Dec. 29, 1999

(30) Foreign Application Priority Data

Dec. 14, 1999 (TW) ..... 88221281

(51) Int. Cl.[7] ..... H01R 4/66
(52) U.S. Cl. ..... 439/92
(58) Field of Search ..... 439/92, 939

(56) References Cited

U.S. PATENT DOCUMENTS

| | | | | |
|---|---|---|---|---|
| 5,108,296 | * | 4/1992 | Takano et al. | 439/92 |
| 5,266,053 | * | 11/1993 | Jamet et al. | 439/939 |
| 5,749,740 | * | 5/1998 | Swift et al. | 439/92 |
| 6,019,614 | * | 2/2000 | Baur et al. | 439/92 |
| 6,068,502 | * | 5/2000 | Kuo | 439/92 |

* cited by examiner

*Primary Examiner*—Gary F. Paumen
(74) *Attorney, Agent, or Firm*—Wei Te Chung

(57) ABSTRACT

A grounding device of the present invention is mounted in an electronic device which comprises a sidewall, an opening, and a bottom base. The grounding device comprises an insulative sleeve aligned with the openings of the electronic device, a grounding plate, and a rivet received in the insulative sleeve. The insulative sleeve defines a coniform hole therethrough and a pair of slots positioned near an end thereof. The insulative sleeve further defines a pair of engaging recesses locating inside the end thereof adjacent the slots. The rivet defines a internal threaded hole therethrough and has a coniform outside surface adapted to interregnal with the inside of the coniform hole. The grounding plate comprises a baseplate, a pair of lateral walls extending upward from the baseplate, and a pair of projections extending inward form opposing edges of the lateral walls. In assembly, the projections of the grounding plate are aligned with the openings of the electronic device and are engaged with the slots of the insulative sleeve. The rivet is then inserted through the openings and into the insulative sleeve, thereby bending the projections into the engaging recesses, thus fastening the sidewall of the electronic device, the grounding plate, the insulative sleeve, and the rivet together. Thus a secure grounding device is formed for attaching a complementary connector to the electronic device.

1 Claim, 5 Drawing Sheets

GROUNDING DEVICE FOR AN ELECTRICAL CONNECTOR

BACKGROUND OF THE INVENTION

The present invention relates to a grounding device, and particularly to a grounding device for an electrical connector for grounding to an electronic device.

A grounding device is mounted in many electrical connectors devices to satisfy the requirement for mating stability of a mating electrical connector. Taiwan Patent application Nos. 81213043 and 83209871 disclose a type of grounding device for an electrical connector. Referring to FIGS. 6 and 7, an electrical connector 7 mates with a wall 6 of an electronic device by insertion of the electrical connector 7 in an opening 62 defined in the wall 6. A grounding device 5 is mounted between the wall 6 and the electrical connector 7. The grounding device 5 includes a pair of screws 71 engaging with the electrical connector 7, a pair of pipes 64 mounted in the wall 6 and a pair of coniform sleeves 65 receiving in the pipes 64. In assembly, the screws 71 are screwed into the sleeves 65, and the sleeves 65 are further inserted into the pipes 64 thereby attaching the electrical connector 7 to the wall 6. However, the sleeves 65 can easily slide from the pipes 64, so the connection between the electrical connector 7 and the wall 6 is not stable. Then the sleeves 65 may fail to electrical contact a grounded surface in the electronic device, so the electrical connector 7 may in turn fail to be grounded leaving the electrical connector 7 vulnerable to EMI, which may disturb the transmission of signals through the electrical connector 7. Hence, an improved electrical connector is required to overcome the disadvantages of the prior art.

BRIEF SUMMARY OF THE INVENTION

A first object of the present invention is to provide a stable connection between an electrical connector and an electronic device;

A second object of the present invention is to provide a grounding connection between the electronic device and the electrical connector to minimize the effects of EMI.

Accordingly, a grounding device of the present invention is mounted in an electronic device which comprises a sidewall, an opening, and a bottom base. The grounding device comprises an insulative sleeve aligned with the openings of the electronic device, a grounding plate, and a rivet received in the insulative sleeve. The insulative sleeve defines a coniform hole therethrough and a pair of slots positioned near an end thereof. The insulative sleeve further defines a pair of engaging recesses locating inside the end thereof adjacent the slots. The rivet defines a internal threaded hole therethrough and has a coniform outside surface adapted to interengage with the inside of the coniform hole. The grounding plate comprises a baseplate, a pair of lateral walls extending upward from the baseplate, and a pair of projections extending inward form opposing edges of the lateral walls. In assembly, the projections of the grounding plate are aligned with the openings of the electronic device and are engaged with the slots of the insulative sleeve. The rivet is then inserted through the openings and into the insulative sleeve, thereby bending the projections into the engaging recesses, thus fastening the sidewall of the electronic device, the grounding plate, the insulative sleeve, and the rivet together. Thus a secure grounding device is formed for attaching a complementary connector to the electronic device.

Other objects, advantages and novel features of the invention will become more apparent from the following detailed description of the present embodiment when taken in conjunction with the accompanying drawings.

DETAILED DESCRIPTION OF THE INVENTION

Figure 1:
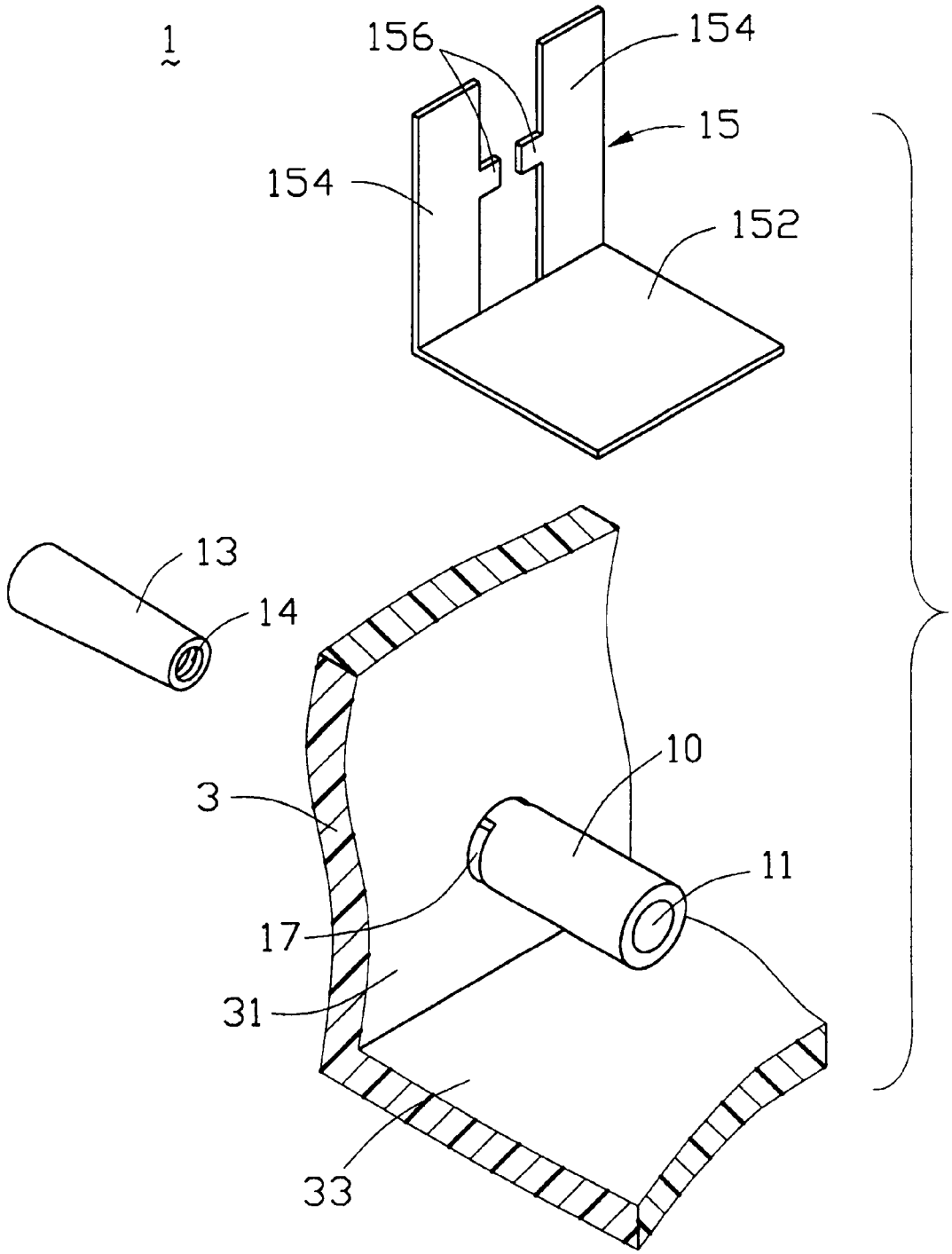
FIG. 1 is an exploded view of a grounding device in accordance with the present invention.
Figure 2:
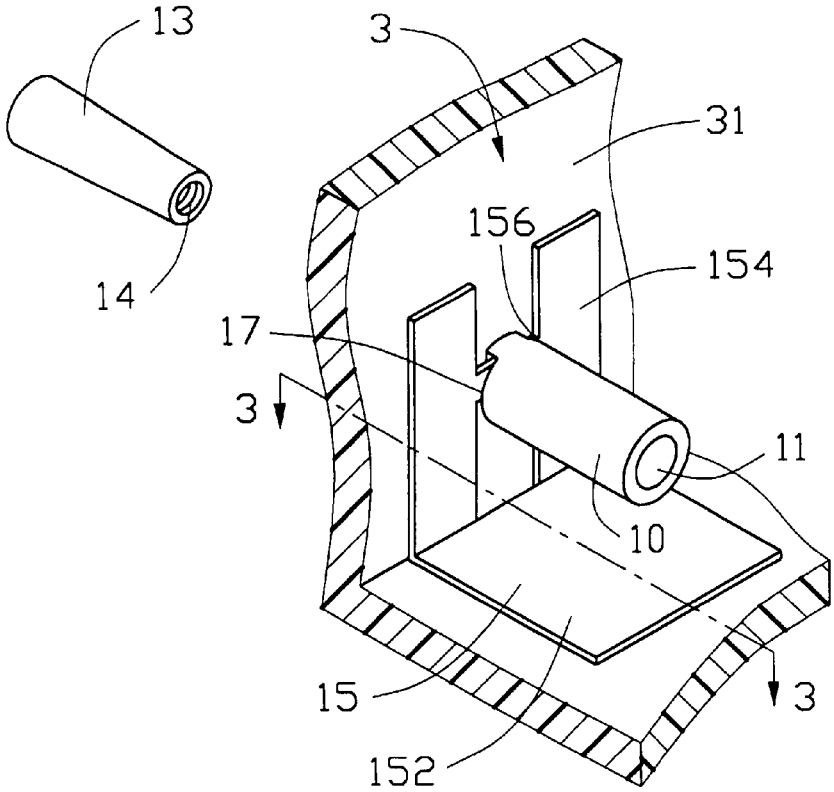
FIG. 2 is a partly assembled view of the grounding device of FIG. 1.

Referring to FIGS. 1–2, a grounding device in accordance with the present invention is mounted in an electronic device 3, and comprises an insulative sleeve 10, a rivet 13, and a grounding plate 15. The electronic device 3 comprises a sidewall 31, and an opening 32 (see FIG. 3) defined in the sidewall 31 and a bottom base 33.

Referring to FIGS. 2–5, the insulative sleeve 10 defines a coniform hole 11 along the longitudinal axis of the insulative sleeve 10 and a pair of slots 17 positioned at an end thereof. In addition, a pair of engaging recesses 18 are located inside the hole of the insulative sleeve 10 adjacent the slots 17.

The rivet 13 defines a threaded hole 14 along the longitudinal axis thereof, and can be inserted into the hole 11 of the insulative sleeve 10. The rivet 13 further has a coniform outside surface adapted to interengage with the coniform hole 11. In addition, the rivet 13 is made of a conductive material.

The conductive grounding plate 15 comprises a horizontal baseplate 152, a pair of lateral walls 154 extending upward from the baseplate 152, a pair of projections 156 having formed on opposite edges (not labelled) of the lateral walls 154 and projecting forward are another. The grounding plate 15 is connected with a grounded component (not shown) of the electronic device 3.

Figure 3:
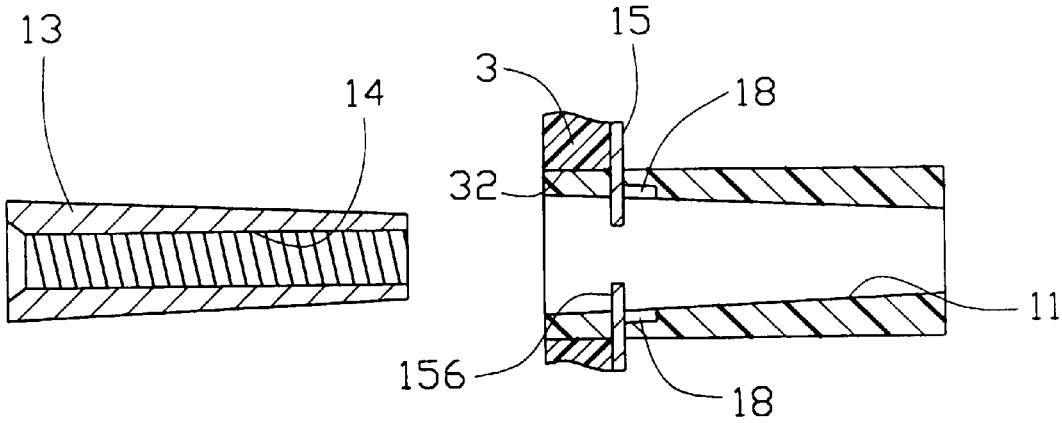
FIG. 3 is a cross-sectional view taken along line IV—IV of FIG. 2.
Figure 4:
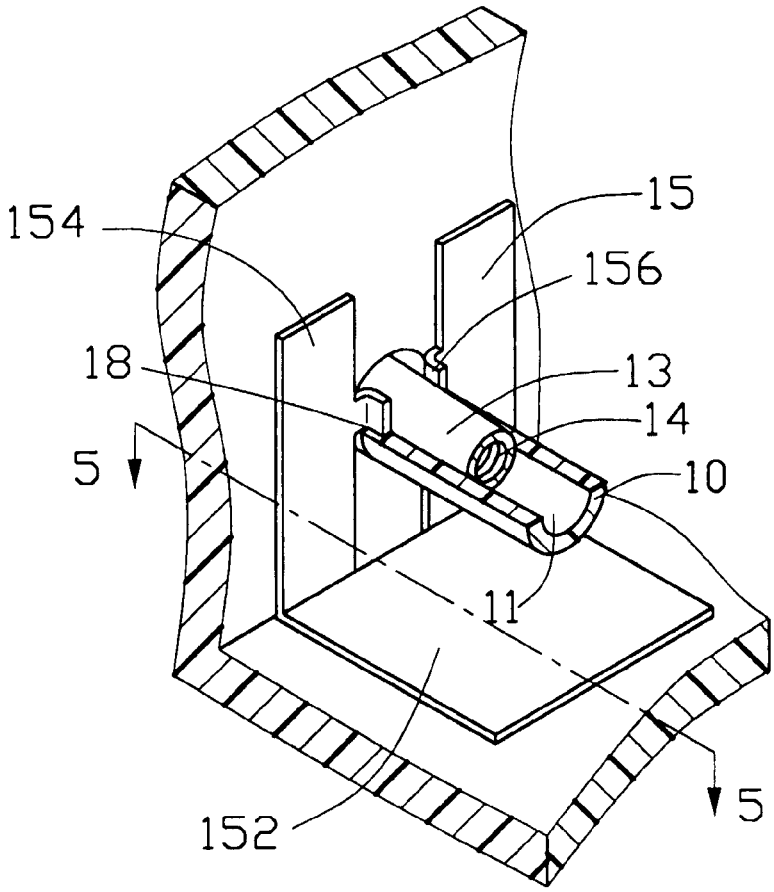
FIG. 4 is a partially at away perspective view of the fully assembled grounding device of FIG. 1.
Figure 5:
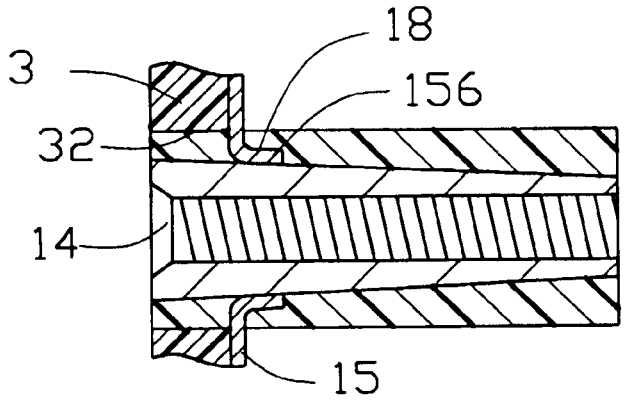
FIG. 5 is a cross-section view taken along line VI—VI of FIG. 4.
Figure 6:
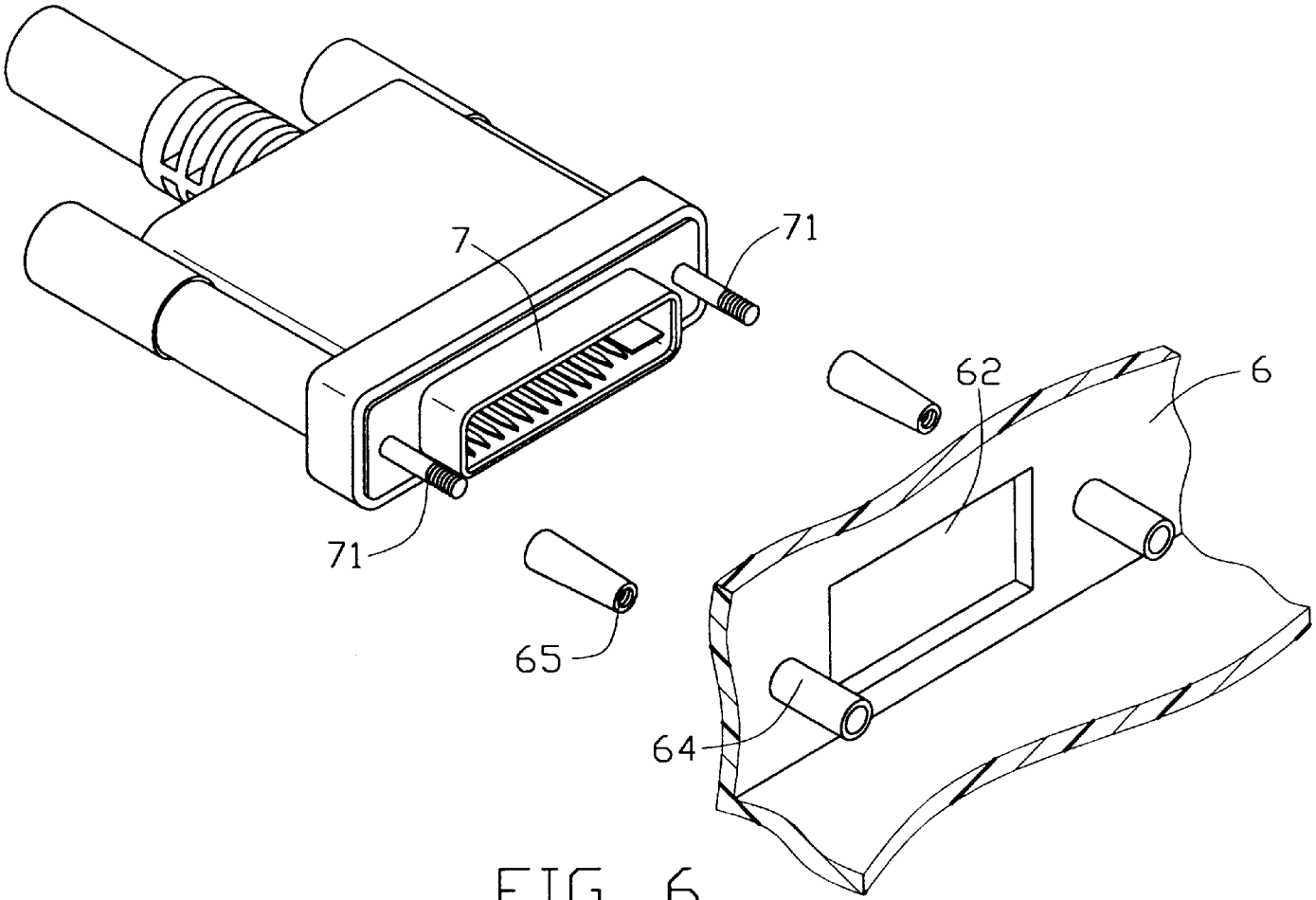
FIG. 6 (PRIOR ART)
FIG. 6 is an exploded view of a prior art grounding device.
Figure 7:
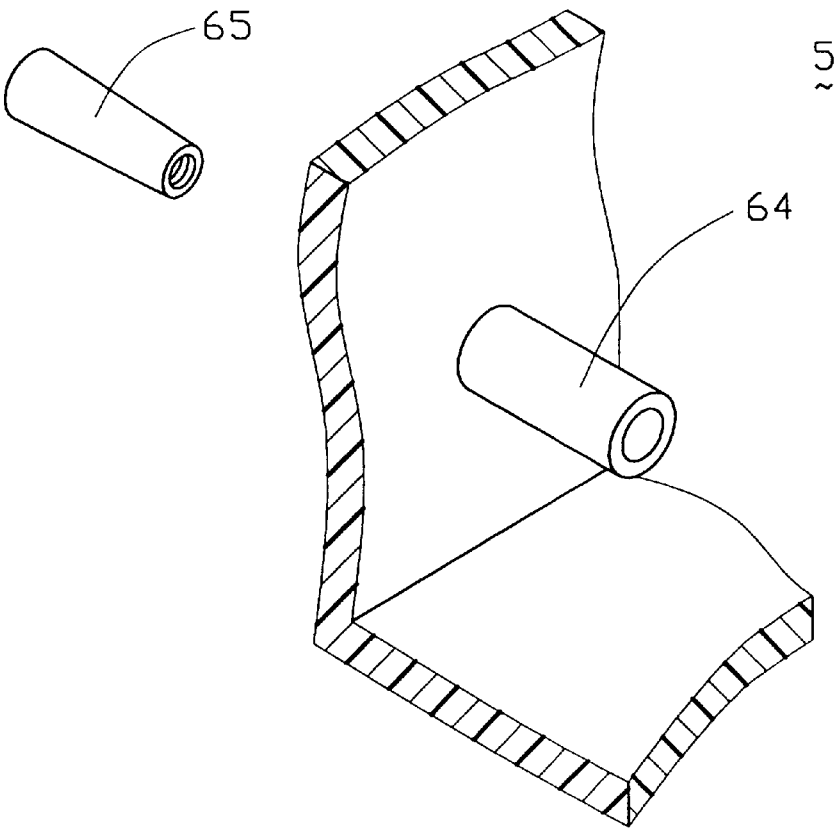
FIG. 7 (PRIOR ART)
FIG. 7 is a partly assembled perspective view of the prior art grounding device.

Referring to FIGS. 3–5, in assembly, the grounding plate 15 is positioned in the electrical device 3 so that the lateral walls 154 and the baseplate 152 of the grounding plate 15 respectively bear against the sidewall 31 and the bottom base 33 of the electronic device 3, and the projection 156 of the lateral walls 154 are aligned with the openings 32 of the sidewall 31. The baseplate 152 is for the electrical connected to a grounded component (not shown) of the electronic device 3. The insulative sleeve 10 is then aligned with the openings 32 of the sidewall 31 so that the projections 156 of the grounding plate 15 engage with the slots 17 of the insulative sleeve 10. The rivet 13 is then inserted, narrow end first, through the openings 32 of the sidewall 31 and into the hole 11 of the insulative sleeve 10, thereby bending the ends of both projections 156 inward into the engaging recesses 18 of the hole 11 (see FIG. 5) so that the ends of both projections 156 are both flush with the inside of the hole 11. Finally, the screw (not shown) of a complementary connector (not shown) is screwed into the threaded hole 14 of the rivet 13, firmly attaching the complementary connector to the electronic device 3. In this way, the rivet 13 is retained in the insulative sleeve 10, and a grounding circuit is formed from the metallic screws 9 of the complementary connector though the conductive rivets 13 and the projections 156 to the grounding plate 15 and finally to the grounded component (not shown) of the electronic device 3, thereby minimizing the effects of EMI.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A grounding device mounted in an electronic device which comprises a sidewall, an opening, and a bottom base, the grounding device comprising:

an insulative sleeve aligned with the opening of the electronic device, the insulative sleeve defining a hole and a pair of slots positioned near an end thereof;

a conductive grounding plate having a baseplate supported on the bottom base and a pair of lateral walls extending upwardly from the baseplate, a pair of projections extending inwardly from opposite edges of the lateral walls into the slots; and a conductive rivet having an internal threaded hole and being received in the insulative sleeve to contact the projections;

wherein the hole of the insulative sleeve is frusto-conical, and the rivet has a frusto-conical outside surface to match the hole;

wherein the slots are diametrically disposed on the insulative sleeve, and the insulative sleeve further has a pair of engaging recesses in communication with the slots;

wherein in assembly, the projections of the lateral walls of the grounding plate engage with the slots of the insulative sleeve, and further bend into the engaging recesses to fasten the grounding plate to the insulative sleeve;

wherein in assembly, the lateral walls of the grounding plate bear against the sidewall of the electronic device.

* * * * *